United States Patent [19]

Boris

[11] 3,954,354

[45] May 4, 1976

[54] SLIDING PISTON PUMP, ESPECIALLY FOR VAPOURIZERS

[75] Inventor: Michel Boris, Paris, France

[73] Assignee: Societe Technique de Pulverisation, Paris, France

[22] Filed: Mar. 18, 1974

[21] Appl. No.: 451,918

[30] Foreign Application Priority Data

Mar. 28, 1973 France ..... 73.11852

[52] U.S. Cl. ..... 417/479; 417/550

[51] Int. Cl.[2] ..... F04B 43/00; F04B 21/04; F04B 39/10

[58] Field of Search ..... 417/550, 479, 552; 137/625.3, 625.33; 222/402.24

[56] References Cited

UNITED STATES PATENTS

| | | | |
|---|---|---|---|
| 378,848 | 2/1888 | Normand | 417/550 |
| 3,749,291 | 7/1973 | Prussia et al. | 222/402.24 |

FOREIGN PATENTS OR APPLICATIONS

| | | | |
|---|---|---|---|
| 832,507 | 4/1960 | United Kingdom | 222/402.24 |
| 1,189,592 | 4/1970 | United Kingdom | 417/550 |

*Primary Examiner*—Carlton R. Croyle
*Assistant Examiner*—Richard E. Gluck
*Attorney, Agent, or Firm*—Eyre, Mann, Lucas & Just

[57] ABSTRACT

A pump primarily intended for incorporation in a dip-tube sprayer includes a hollow piston slidable in a cylinder which communicates with an outlet tube. The piston defines a seat for a valve which in the inoperative condition prevents communication between the cylinder and the outlet or delivery tube. The piston has the form of a shallow cup and is not totally covered by the valve when seated. One or more bleeds are provided in the part of the piston covered by the valve.

6 Claims, 7 Drawing Figures

SLIDING PISTON PUMP, ESPECIALLY FOR VAPOURIZERS

BACKGROUND OF THE INVENTION

1. Field of the Invention

This invention relates to pumps, for example for incorporation in dip-tube sprayers.

2. Description of the Prior Art

At the present time pumps are known which comprise a hollow piston slidably mounted in a cylinder communicating with an outlet tube with which it is coaxial, and forming a seat for a valve which, at rest, is held by a spring against the piston, the communication between the cylinder and the tube thus being interrupted, and can be changed over to an open position by axial displacement of the tube.

In one such pump, the outlet tube is rigid with the valve and is movable, over a limited distance, with respect to the piston. In order to operate the pump, the tube is displaced towards the cylinder which initially drives the valve thereby displacing it from its seat, then the piston which delivers the liquid contained in the cylinder to the tube.

This pump however gives rise to certain disadvantages, in particular when it is incorporated in a dip-tube sprayer in which the outlet tube is connected to an atomizing nozzle. In practice, if the tube is displaced slowly, the delivery pressure is initially very low and the atomization is poor; it may even happen that the liquid only leaves the nozzle in the form of a broken up jet.

An object of the present invention is to provide an improved pump suitable for incorporation in a dip-tube sprayer.

SUMMARY OF THE INVENTION

According to the present invention there is provided a pump comprising a cylinder, a hollow piston slidably mounted in the cylinder and defining a valve seat, an outlet tube communicating with the cylinder and coaxial therewith, a valve which, at rest, is seated on said valve seat, a spring biasing the valve on to the seat in which position communication between the cylinder and the tube is prevented, said piston taking the form of a shallow cup and being movable with the outlet tube so that the valve is seated on the piston when at rest, and the valve has an area less than that of the area of the base of the piston, at least one bleed being formed in the part of the base of the piston adapted to be covered by the valve. Alternatively, at least one bleed could be provided in the part of the valve which covers the base.

When the outlet tube is moved, it drives simultaneously the piston and the valve, which compresses the liquid in the cylinder. This pressure is exerted on the part of the base of the piston which lies outside the periphery of the valve; when it has reached a predetermined value, it deforms this part which thus becomes spaced from the valve, and this enables the liquid to pass into the tube through the bleeds. At the end of the stroke, the pressure falls and the base of the piston is again seated on the valve, thus interrupting communication between the cylinder and the tube.

The piston may if desired be moulded in one with the tube.

BRIEF DESCRIPTION OF THE DRAWINGS

Two embodiments of a pump in accordance with the invention, will now be described, by way of example, with reference to the accompanying diagrammatic drawings, in which.

DESCRIPTION OF THE PREFERRED EMBODIMENTS

Figure 1:
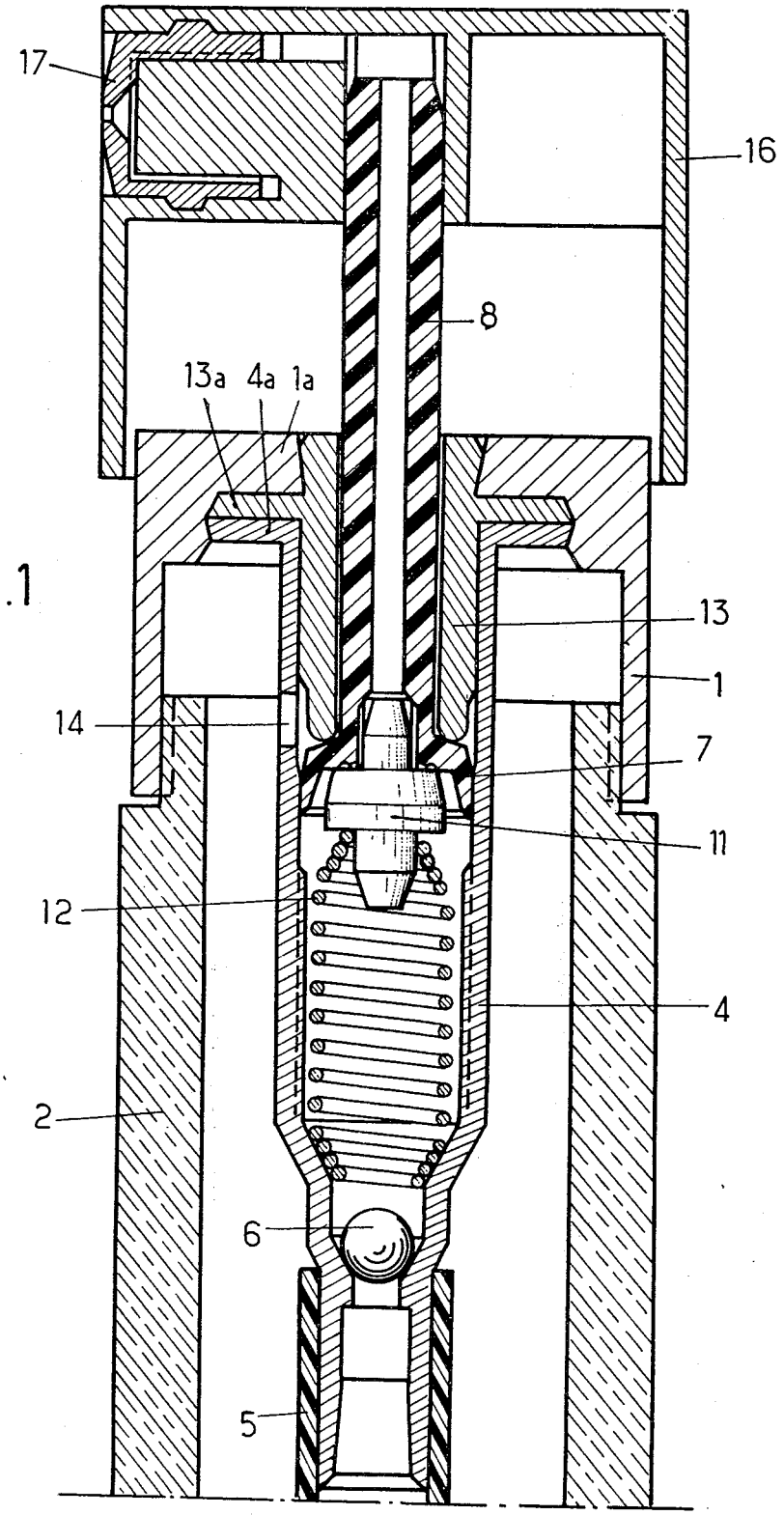
FIG. 1 is a sectional view of one embodiment of a pump forming part of a dip-tube sprayer.
Figure 2:
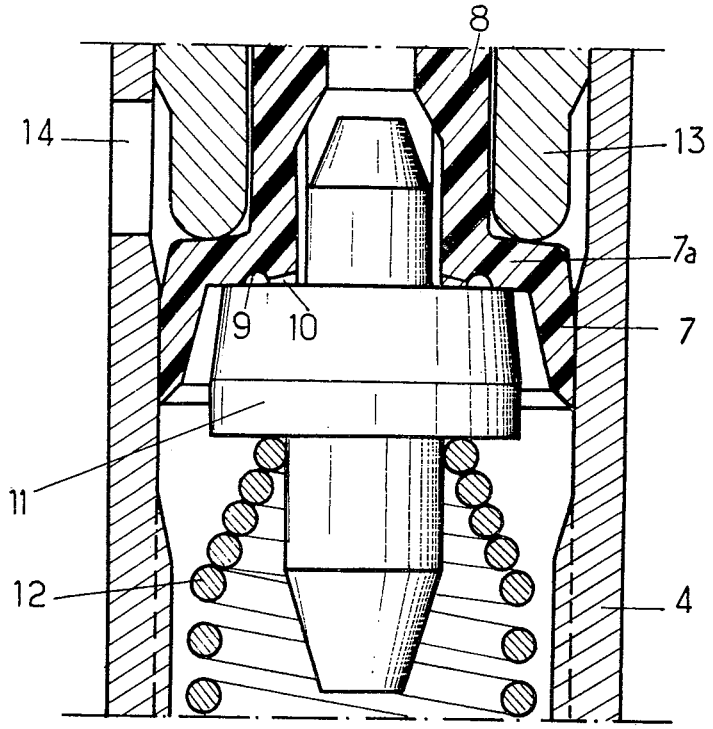
FIG. 2 is a longitudinal section, to an enlarged scale, of a part of the pump and sprayer of FIG. 1, in its closed position.

As is shown in FIGS. 1 and 2, one embodiment of a pump in accordance with the invention incorporated in a dip-tube sprayer comprises a hollow cylindrical member 1, intended to be secured onto a container 2 containing liquid to be atomized, vapourized or otherwise sprayed, and forming a closure for this container. To this end the cylindrical member 1, which is of a plastic material, for example, is screwthreaded and can be screwed on to the neck of the container.

A cylindrical pump chamber is mounted in the body 1 at its upper part by means of an external flange **4*a*, abutting against an internal shoulder 1*a* of the body 1. The pump chamber 4 is extended, at its lower end, by a dip tube 5 with the interposition of a non-return valve 6**.

A piston 7 is slidably mounted in the chamber 4 and is integral with an outlet tube 8. The piston 7 is cup-like and its connection with the tube 8, is provided by the base part **7*a* of the cup which cup is relatively shallow and the base part of which is substantially plane. An annular groove 9 is formed in the internal face of the base part 7*a* and communicates with the tube 8 through a series of equally-spaced bleeds 10. The base part 7*a* forms a seat for a valve 11 which a spring 12**, interposed between the valve and the base of the chamber, biases on to the seat; the diameter of this valve is less than the internal diameter of the base of the cup.

The tube 8 passes through an aperture provided in the base of a sleeve 13 which is mounted on an upper part of the pump chamber 4 and comprises an external flange **13*a* clamped between the shoulder 1*a* of the cylindrical body 1 and the external flange 4*a*** of the pump chamber.

At rest, the base part **7*a* of the piston 7 is in abutment against the lower edge of the sleeve 13. An aperture 14 is formed in the pump chamber 4** substantially opposite this base part.

The upper part of the tube 8 is secured to a button 16 and communicates with an atomizing or other spraying nozzle 17 secured in a lateral wall of the button.

In FIGS. 1 and 2 the sprayer is inoperative. The spring 12 holds the valve 11 against the base part **7*a* of the piston; it also holds this base part in abutment against the face of the sleeve 13, which serves to shut-off the aperture 14. The pump chamber 4 and the interior of the container 2** are thus isolated from the ambient and no loss is possible.

In order to use the dip-tube sprayer which has just been described, pressure is applied to the button 16; the assembly constituted by the tube 8, the piston 7 and the valve 11 are displaced in the direction of the base part of the pump chamber 4, against the action of the spring 12. The base part *7a* of the piston 7 is spaced from the face of the sleeve 13, the interior of the container is placed in communication with the ambient through the aperture 14 and the clearance between the sleeve 13 and the tube 8.

Figure 3:
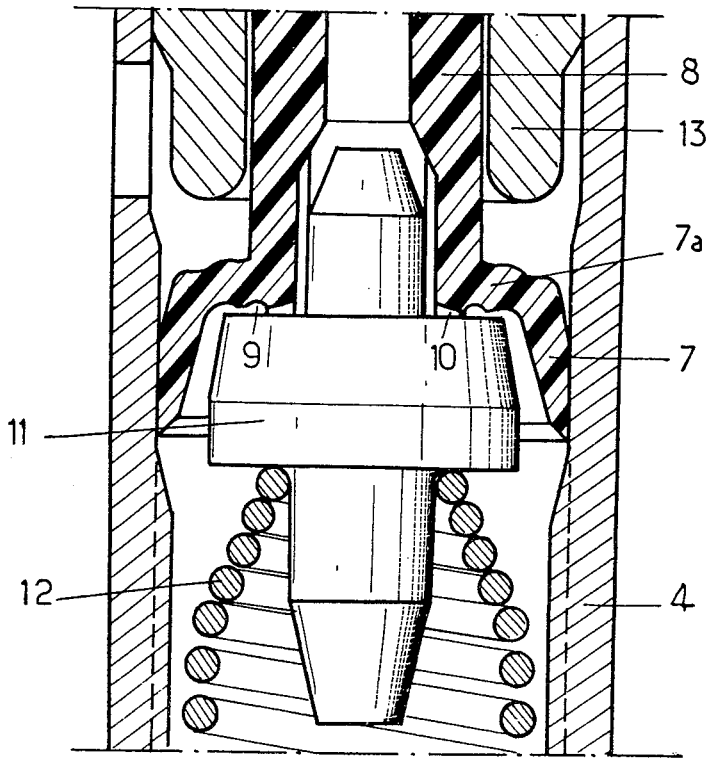
FIG. 3 is a section similar to FIG. 2 but with the sprayer in an open position.

The piston 7, when descending in the pump chamber, compresses the liquid which is contained in this chamber. The pressure of the liquid is exerted on the part of the base *7a* of the piston which is beyond the periphery of the valve and is thus no longer sustained, as was the case at rest, by the face of the tube 8. When this pressure reaches a sufficient value, the base deforms, as indicated in FIG. 3 and moves away from the valve; the liquid can thus be ejected through the nozzle 17, under a predetermined pressure, through the intermediary of the bleeds 10 and the tube 8.

The atomization or other spraying continues progressively as the piston 7 descends and delivers the liquid in the tube 8. At the end of the stroke, the pressure in the chamber 4 falls and the base part *7a* of the piston resumes its initial position and re-seats on the valve 11. The delivery of liquid to the nozzle 17 is thus interrupted, whilst the back pressure takes on a predetermined value.

Figure 4:
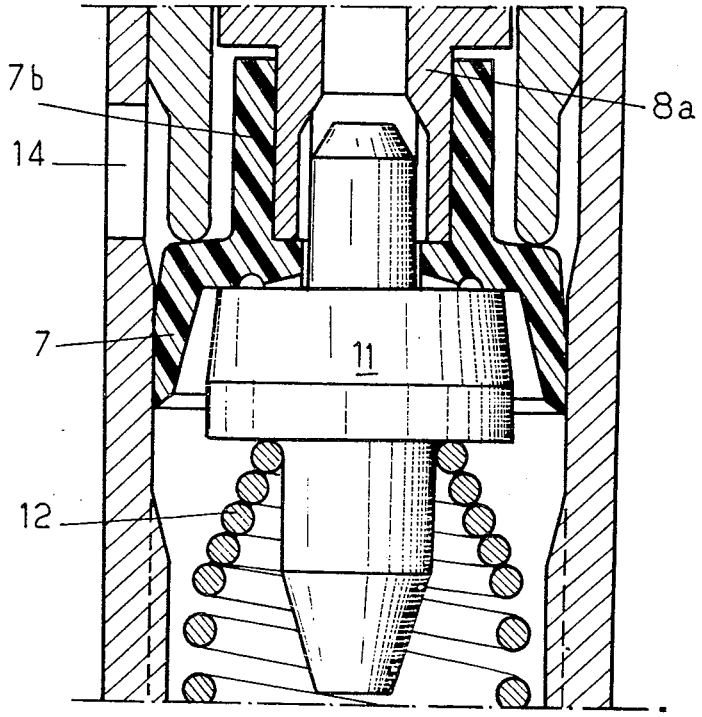
FIGS. 4 and 5 are views similar to those of FIGS. 2 and 3 of another embodiment.
Figure 5:
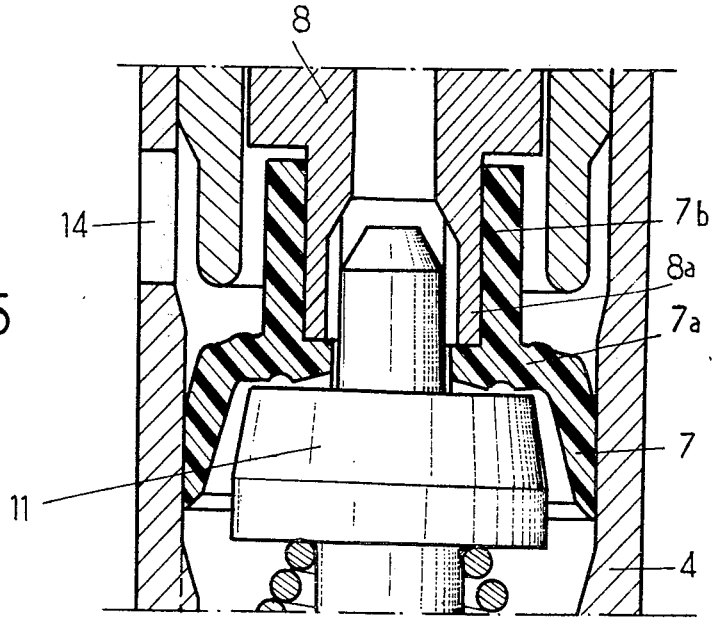
Figure 6:
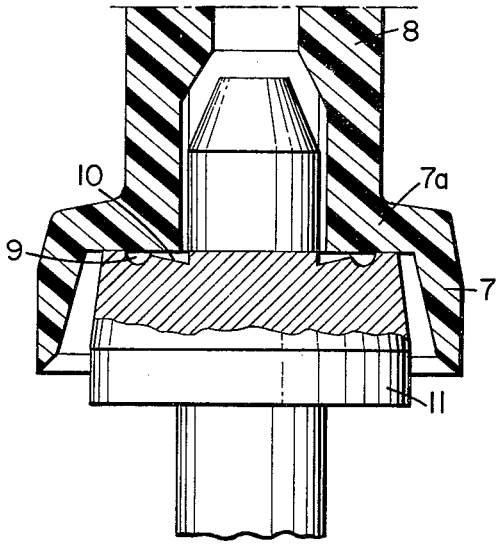
FIG. 6 is a view similar to FIG. 2, however the bleed passage is in the valve.
Figure 7:
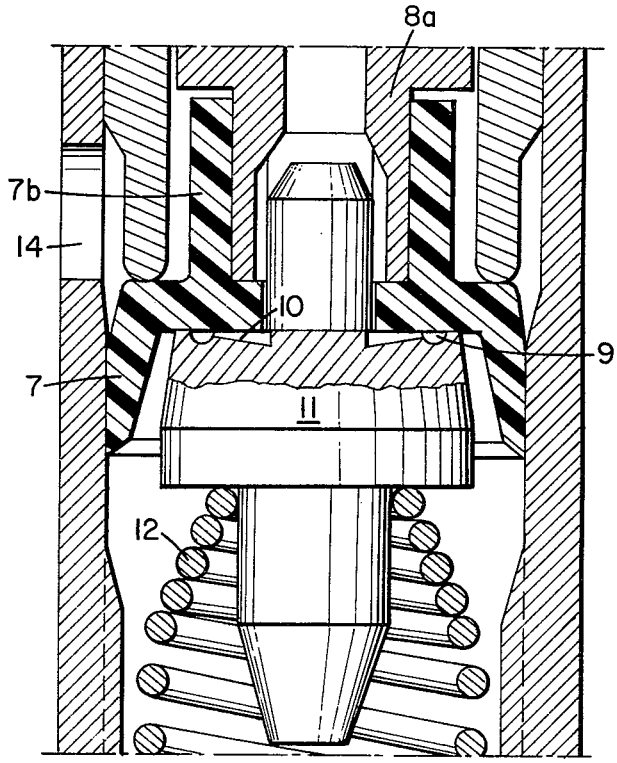
FIG. 7 is a view similar to FIG. 4, however, the bleed passage is in the valve.

The embodiment of FIGS. 4 and 5 is similar in its general outline to that of the embodiment of FIGS. 1 and 2, but the piston 7 is here independent of the tube 8 and comprises an extension *7b* mounted on an extension *8a* of the tube. As in the embodiment of FIGS. 1 and 2, the base part *7a* of the piston 7 deforms, when the pressure in the pump chamber 4 reaches a predetermined value, thus permitting the liquid to pass to the nozzle 17.

I claim:

1. A pump comprising:

a cylinder, an aperture providing an inlet formed in said cylinder, a hollow piston having a base slidably mounted in the cylinder and defining a valve seat, an outlet tube communicating with the cylinder and coaxial therewith, said outlet tube being integral with said piston, a valve which, at rest, is seated on said valve seat, said valve having an area less than that of the area of the base of said piston, a spring biasing the valve onto the seat in which position communication between the cylinder and the tube is prevented, said piston taking the form of a shallow cup and being movable with the outlet tube so that the valve is seated on the piston when at rest, a plurality of passages serving as bleeds between the cylinder and the tube, said passages being formed in the part of the base of the piston adapted to be covered by the valve, and the radially outermost portion of the base of the piston being capable of deforming and permitting the bleed passages to establish communication between the cylinder and the outlet tube.

2. A pump according to claim 1 further comprising an annular groove interconnecting said plurality of bleeds.

3. A pump comprising:

a cylinder, an aperture providing an inlet formed in said cylinder, a hollow piston having a base slidably mounted in the cylinder and defining a valve seat, an outlet tube communicating with the cylinder and coaxial therewith, said outlet tube being intergral with said piston, a valve which, at rest, is seated on said valve seat, said valve having an area less than that of the area of the base of said piston, a spring biasing the valve onto the seat in which position communication between the cylinder and the tube is prevented, said piston taking the form of a shallow cup and being movable with the outlet tube so that the valve is seated on the piston when at rest, a plurality of passages serving as bleeds between the cylinder and the tube, said passages being formed in the part of the valve which covers the base of the piston, and the radially outermost portion of the base of the piston being capable of deforming and permitting the bleed passages to establish communication between the cylinder and the outlet tube.

4. A pump according to claim 3 further comprising an annular groove interconnecting said plurality of bleeds.

5. A pump comprising:

a cylinder, an aperture providing an inlet formed in said cylinder, a hollow piston having a base slidably mounted in the cylinder and defining a valve seat, an outlet tube communicating with the cylinder and coaxial therewith, said piston and outlet tube being separate pieces each of which has a cylindrical coaxial extension, the extension of the outlet tube being non-deformable, said piston having a shoulder for engagement with the lowermost end of the extension of the outlet tube; the length of the extension of the piston above the shoulder is less than the length of the extension of the outlet tube and whereby the extension of the piston is non-deformable, a valve which, at rest, is seated on said valve seat, said valve having an area less than that of the area of the base of said piston, a spring biasing the valve onto the seat in which position communication between the cylinder and the tube is prevented, said piston taking the form of a shallow cup and being movable with the outlet tube so that the valve is seated on the piston when at rest, a plurality of passages serving as bleeds between the cylinder and the tube, said passages being formed in the part of the base of the piston adapted to be covered by the valve, and the radially outermost portion of the base of the piston being capable of deforming and permitting the bleed passages to establish communication between the cylinder and the outlet tube.

6. A pump comprising a cylinder, an aperture providing an inlet formed in said cylinder, a hollow piston having a base slidably mounted in the cylinder and defining a valve seat, an outlet tube communicating with the cylinder and coaxial therewith, said piston and outlet tube being separate pieces each of which has a cylindrical coaxial extension, the extension of the outlet tube being non-deformable, said piston having a shoulder for engagement with the lowermost end of the extension of the outlet tube; the length of the extension of the piston above the shoulder is less than the length of the extension of the outlet tube and whereby the extension of the piston is nondeformable, a valve which, at rest, is seated on said valve seat, said valve having an area less than that of the area of the base of said piston, a spring biasing the valve onto the seat in which position communication between the cylinder and the tube is prevented, said piston taking the form of a shallow cup and being movable with the outlet tube so that the valve is seated on the piston when at rest, a plurality of passages serving as bleeds between the cylinder and the tube, said passages being formed in the part of the valve which covers the base of the piston, and the radially outermost portion of the base of the piston being capable of deforming and permitting the bleed passages to establish communication between the cylinder and the outlet.

* * * * *